US012421880B2

(12) United States Patent
Nomura

(10) Patent No.: US 12,421,880 B2
(45) Date of Patent: Sep. 23, 2025

(54) EXHAUST VALVE AND METHOD FOR MANUFACTURING SAME

(71) Applicant: SANKEI GIKEN KOGYO CO., LTD., Tokyo (JP)

(72) Inventor: Tetsuaki Nomura, Isesaki (JP)

(73) Assignee: SANKEI GIKEN KOGYO CO., LTD., Tokyo (JP)

( * ) Notice: Subject to any disclaimer, the term of this patent is extended or adjusted under 35 U.S.C. 154(b) by 196 days.

(21) Appl. No.: 18/283,046

(22) PCT Filed: Mar. 26, 2021

(86) PCT No.: PCT/JP2021/013157

§ 371 (c)(1),
(2) Date: Sep. 20, 2023

(87) PCT Pub. No.: WO2022/201557

PCT Pub. Date: Sep. 29, 2022

(65) Prior Publication Data

US 2024/0167405 A1 May 23, 2024

(51) Int. Cl.
*F01N 1/18* (2006.01)
*F01N 1/16* (2006.01)
(Continued)

(52) U.S. Cl.
CPC ..... *F01N 1/18* (2013.01); *F01N 1/165* (2013.01)

(58) Field of Classification Search
CPC . F01N 1/18; F01N 1/165; F01N 1/166; F01N 1/16; F01N 13/08; F01N 13/18;
(Continued)

(56) References Cited

U.S. PATENT DOCUMENTS 4,380,246 A * 4/1983 Casale ..... F16K 27/0218 137/340
5,265,846 A * 11/1993 Shreve ..... F16K 1/22 251/188
(Continued)

FOREIGN PATENT DOCUMENTS

DE 102011100238 A1 * 11/2012 ..... F01N 1/168
DE 102011107024 B4 * 2/2019 ..... F02D 9/04
(Continued)

OTHER PUBLICATIONS

Translation of Written Opinion of the International Searching Authority for PCT/JP2021/013157 (Year: 2021).*
(Continued)

*Primary Examiner* — Edgardo San Martin
(74) *Attorney, Agent, or Firm* — WHDA, LLP

(57) ABSTRACT

An exhaust valve includes a pipe body connecting an upstream pipe and a downstream pipe for exhaust, a valve plate disposed inside the pipe body in a state of being attached to a rotary shaft that rotates by drive of an actuator, the valve plate configured to rotate to open/close an exhaust flow path inside the pipe body, and a stopper fixed inside the pipe body. The stopper is a member including, formed integrally, a base portion including an insertion hole configured to receive insertion of the rotary shaft, a first contact portion extending along an inner peripheral surface of the pipe body on one side of the base portion upstream and downstream of the exhaust, and a second contact portion extending along the inner peripheral surface on another side of the base portion upstream and downstream of the exhaust, on a side opposite to the first contact portion.

4 Claims, 6 Drawing Sheets

(51) Int. Cl.
*F16K 1/22* (2006.01)
*F16K 1/226* (2006.01)

(58) Field of Classification Search
CPC . F01N 13/087; F02D 9/04; F02D 9/08; F02D 9/10; F02D 9/104; F02D 9/1045; F16K 1/22; F16K 1/2263; F16K 1/226; F16K 27/0218; F16K 51/00
See application file for complete search history.

(56) References Cited

U.S. PATENT DOCUMENTS 5,630,571 A * 5/1997 Kipp ..... F16K 1/2268 251/308
5,669,350 A * 9/1997 Altmann ..... F02D 9/1015 425/588
5,979,870 A * 11/1999 Junier ..... F16K 1/22 251/305
6,138,640 A * 10/2000 Asanuma ..... F02D 9/104 251/305
6,981,519 B2 * 1/2006 Heckt ..... F16K 1/222 137/599.17
7,712,312 B2 * 5/2010 Sexton ..... F16K 1/2007 137/601.11
8,136,793 B2 * 3/2012 Keller-Staub ..... F16K 1/222 251/308
10,167,785 B2 1/2019 Oblinger et al.
10,738,715 B2 * 8/2020 Ishii ..... F02D 9/04
12,259,053 B2 * 3/2025 Nomura ..... F16K 27/0218

FOREIGN PATENT DOCUMENTS

JP 03286152 A * 12/1991
JP H06-24271 U 3/1994
JP 2006-105094 A 4/2006
JP 2021139298 A * 9/2021
JP 2021139299 A * 9/2021
WO WO-2015111334 A1 * 7/2015 ..... F16K 27/0218

OTHER PUBLICATIONS

International Search Report dated May 25, 2021, issued in counterpart International Application No. PCT/ JP2021/013157. (2 pages).

* cited by examiner

EXHAUST VALVE AND METHOD FOR MANUFACTURING SAME

TECHNICAL FIELD

The present invention relates to an exhaust valve that is installed in an exhaust path through which exhaust from an automobile or the like flows and that uses an open/close operation to regulate a flow rate of the exhaust and exhaust noise, and a method for manufacturing the exhaust valve.

BACKGROUND ART

In the related art, the exhaust valve described in Patent Document 1 is known as an exhaust valve that is installed in an exhaust path through which exhaust from an automobile or the like flows and that uses an open/close operation to regulate the flow rate of the exhaust. In the exhaust valve of Patent Document 1, a pipe body that connects an upstream pipe and a downstream pipe for exhaust is installed, a shutter that rotates in response to rotation of a rotary shaft when driven by an actuator is installed in the pipe body, a substantially arc-shaped first stopper and a substantially arc-shaped second stopper, each disposed on a downstream side and an upstream side of the pipe body, respectively, are attached by welding to an inner surface of the pipe body, and the rotating shutter comes into contact with the substantially arc-shaped first stopper and the substantially arc-shaped second stopper at a position at which the shutter closes the exhaust path.

As an exhaust valve with a different structure, there is known an exhaust valve in which a thick pipe body is used as the pipe body that connects an upstream pipe and a downstream pipe for exhaust, portions corresponding to the first stopper and the second stopper described above are formed by cutting an inner side of the pipe body, and the rotating shutter comes into contact with the first stopper and the second stopper formed by cutting at a position at which the shutter closes exhaust path.

CITED DOCUMENTS

Patent Literature

Patent Document 1: U.S. Ser. No. 10/167,785 B

SUMMARY OF INVENTION

Problem to be Solved by Invention

In the exhaust valve of Patent Document 1, to ensure positional accuracy when welding the first stopper and the second stopper, which are separate members, to the pipe body to manufacture the exhaust valve, two positioning and fitting mechanisms, that is, one positioning and fitting mechanism that positions, holds and fits the first stopper and the pipe body when the first stopper is welded to the pipe body and another positioning and fitting mechanism that positions, holds and fits the second stopper and the pipe body when the second stopper is welded to the pipe body are used, meaning that two positioning and welding processes are required. This leads to poor manufacturing efficiency and high manufacturing costs.

In addition, in the exhaust valve of Patent Document 1, a gap used for fitting and positioning the first stopper into the pipe body and a gap used for fitting and positioning the second stopper into the pipe body need to be set before the first stopper is attached to the inside of the pipe body and the second stopper is attached to the inside of the pipe body. This results in a large number of gaps used for fitting and positioning. When there are a large number of gaps used for fitting and positioning, fitting accuracy between the first stopper and second stopper and the pipe body decreases and product accuracy after assembly decreases.

Further, in the exhaust valve with the different structure in which portions corresponding to the first stopper and the second stopper described above are formed by cutting, manufacturing costs are high because a cutting process is required. In addition, a thick pipe body needs to be used to ensure a sufficient cutting margin for the cutting process, which increases the weight of the exhaust valve. An increase in the weight of the exhaust valve leads to lower fuel efficiency when the exhaust valve is installed in an exhaust path of an automobile.

The present invention has been made in view of the above-described problems, and an object of the present invention is to provide an exhaust valve that is lightweight, can improve manufacturing efficiency, reduce manufacturing costs, and improve product accuracy, and a method for manufacturing the exhaust valve.

Solution to Problem

An exhaust valve according to the present invention includes a pipe body connecting an upstream pipe and a downstream pipe for exhaust, a valve plate disposed inside the pipe body in a state of being attached to a rotary shaft that rotates by drive of an actuator, the valve plate configured to rotate to open/close an exhaust flow path inside the pipe body, and a stopper fixed inside the pipe body, in which the stopper is a member including, formed integrally, a base portion including an insertion hole configured to receive insertion of the rotary shaft, a first contact portion extending along an inner peripheral surface of the pipe body on one side of the base portion upstream and downstream of the exhaust, and a second contact portion extending along the inner peripheral side of the pipe body on another side of the base portion upstream and downstream of the exhaust, on a side opposite to the first contact portion, and the valve plate comes into contact with the first contact portion and the second contact portion at a position at which the valve plate closes the exhaust flow path.

With this configuration, since the stopper is formed as an integral member, the number of components can be reduced, the number of positioning and fitting mechanisms and the number of positioning and fitting processes used to position the stopper and the pipe body can be reduced, manufacturing efficiency can be improved, and manufacturing costs can be reduced. In addition, since one stopper, which is formed as an integral member, and the pipe body need only be fitted together for assembly, gaps used for fitting and positioning can be reduced, fitting accuracy between the stopper and the pipe body and product accuracy after assembly can be enhanced, and product quality of the exhaust valve can be improved.

In the exhaust valve according to the present invention, the first contact portion and the second contact portion are each formed in a substantially arc shape, and a distance, in an axial direction of the pipe body, between a contact surface, of the first contact portion, at which the valve plate makes contact and a contact surface, of the second contact portion, at which the valve plate makes contact is set larger than an axial diameter of the rotary shaft.

With this configuration, interference and contact between the first contact portion, the second contact portion and the rotary shaft of the valve plate at positions opposing the base portion of the stopper in the pipe body can be prevented, and assembly work of the rotary shaft can be facilitated. In addition, one or both of a distal end of the first contact portion having a substantially arc shape and a distal end of the second contact portion having a substantially arc shape can be made to extend until a position overlapping the rotary shaft in the pipe body axial direction, the distance and area by which one or both of the contact surface of the first contact portion and the contact surface of the second contact portion come into contact with the valve plate can be increased, and exhaust leakage when the valve plate is at the closed position can be suppressed to the extent possible. In addition, while manufacturing accuracy can be improved due to the position alignment between the rotary shaft insertion hole of the pipe body and the insertion hole of the rotary shaft of the base portion, since the first contact portion and the second contact portion having substantially arc shapes are disposed separated from each other at positions opposing the base portion of the stopper in the pipe body, the tolerance for dimensional accuracy and yield can be increased.

A method for manufacturing an exhaust valve according to the present invention is a method for manufacturing the exhaust valve according to the present invention, the method including a step of aligning a position of the insertion hole of the base portion of the stopper being a member including, formed integrally, the base portion including the insertion hole configured to receive insertion of the rotary shaft, the first contact portion extending along the inner peripheral surface of the pipe body on one side of the base portion upstream and downstream of the base portion, and the second contact portion extending along the inner peripheral side of the pipe body on another side of the base portion upstream and downstream of the base portion, on a side opposite to the first contact portion, and a position of a rotary shaft insertion hole formed in a peripheral wall of the pipe body connecting an upstream pipe and a downstream pipe for exhaust, to fit the stopper into the pipe body.

With this configuration, the position of the insertion hole of the rotary shaft of the base portion of the stopper and the position of the rotary shaft insertion hole formed in the peripheral wall of the pipe body are aligned and, if this alignment is used as a reference when assembling the exhaust valve, manufacturing work can be facilitated. Further, required concentricity between the insertion hole of the rotary shaft of the stopper, the rotary shaft insertion hole formed in the peripheral wall of the pipe body, and the rotary shaft can be easily ensured and, from this perspective, manufacturing accuracy and manufacturing quality of the exhaust valve can be increased. Additionally, since required concentricity between the insertion hole of the rotary shaft of the stopper, the rotary shaft insertion hole formed in the peripheral wall of the pipe body, and the rotary shaft can be more easily ensured, friction generated in the rotation operation of the rotary shaft and the valve plate can be reduced for a smoother rotation operation, the valve plate can be made to more reliably come into contact with the contact surface of the first contact portion and the contact surface of the second contact portion at a set contact distance and contact area, and exhaust leakage when the valve plate is at the closed position can be suppressed to the extent possible.

Effects of Invention

The exhaust valve according to the present invention is lightweight and can improve manufacturing efficiency, reduce manufacturing costs, and improve product accuracy.

DESCRIPTION OF EMBODIMENTS

Exhaust Valve According to Embodiment

Figure 1:
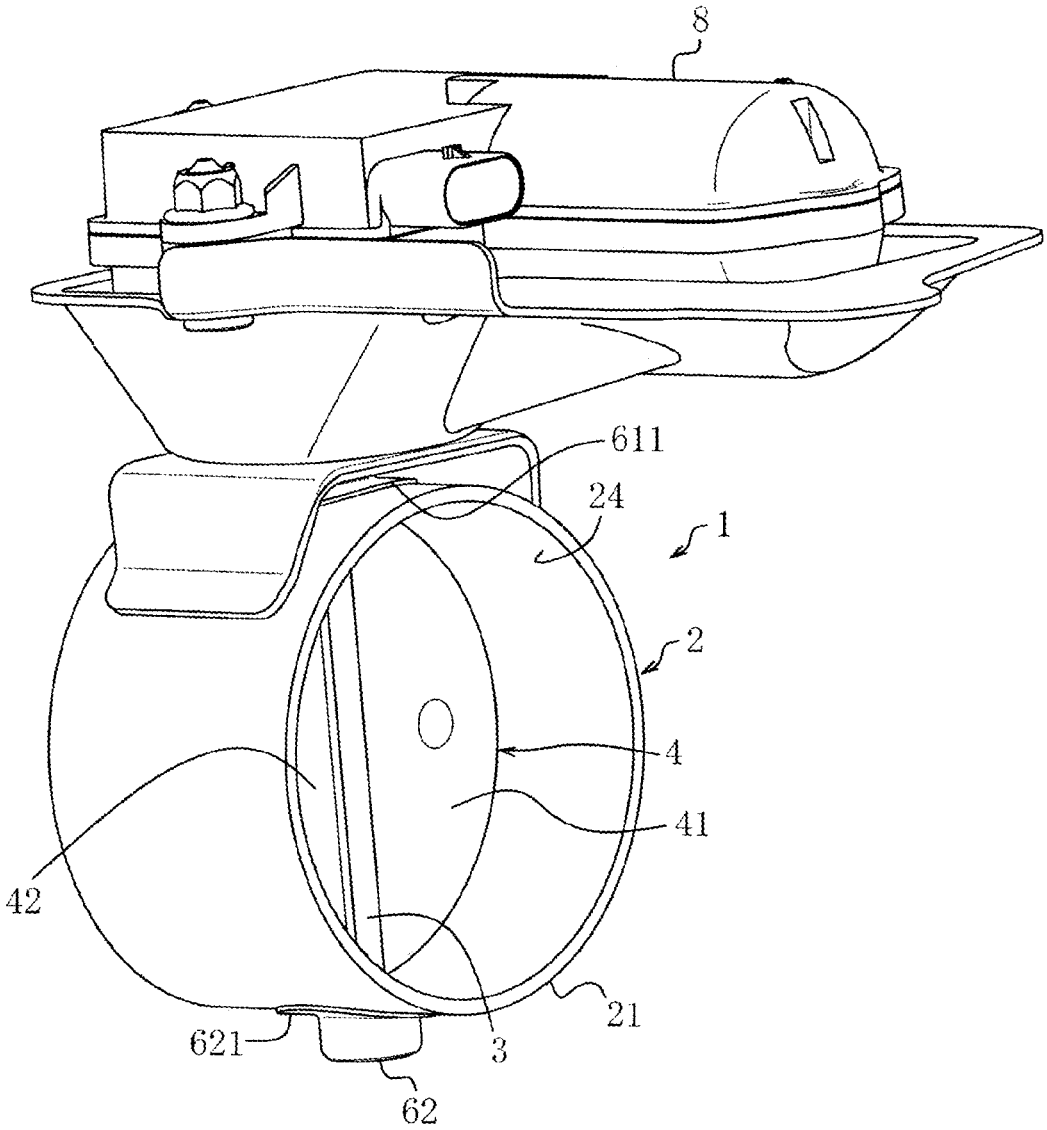
FIG. 1 is a schematic view illustrating a closed state of an exhaust valve according to an embodiment of the present invention.
Figure 2:
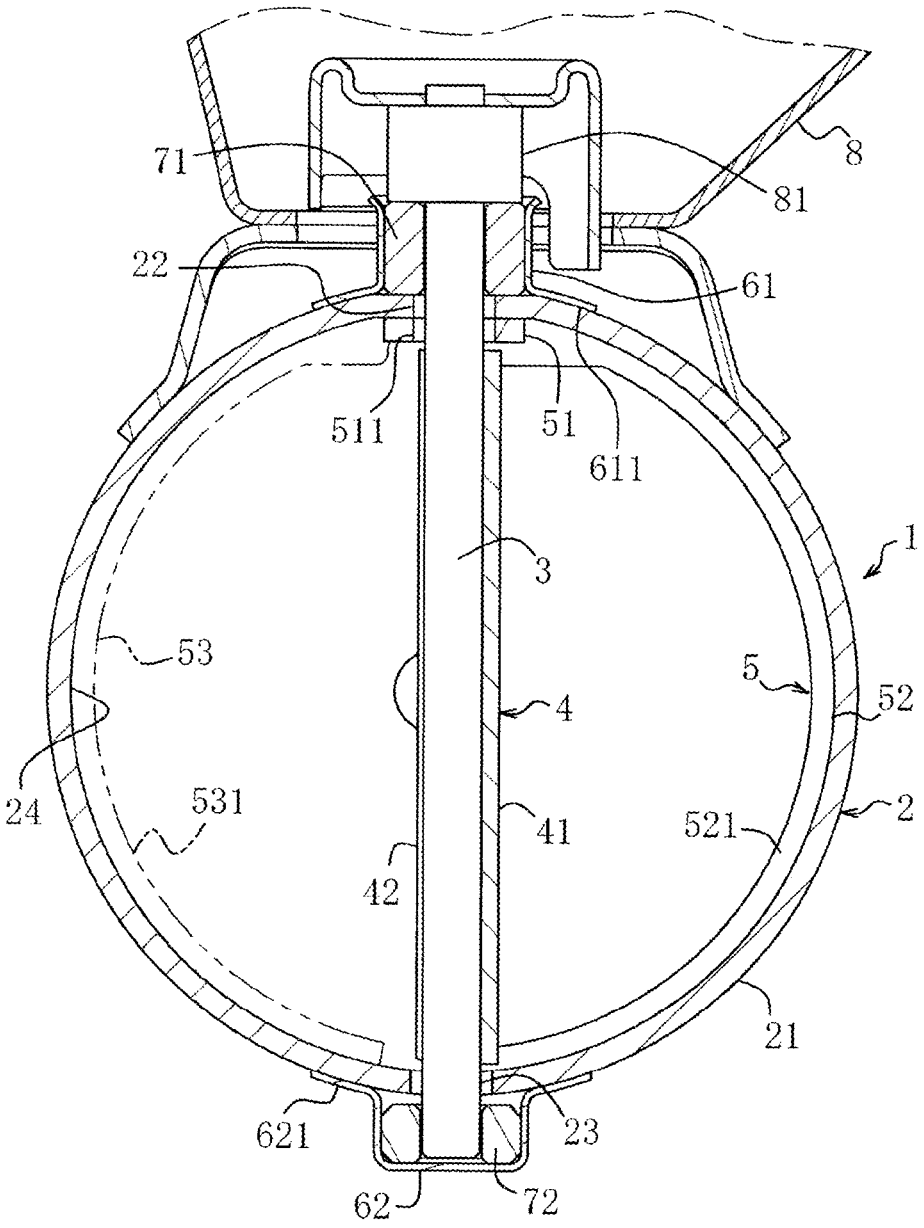
FIG. 2 is a transverse cross-sectional view illustrating an open state of the exhaust valve according to the embodiment.
Figure 3:
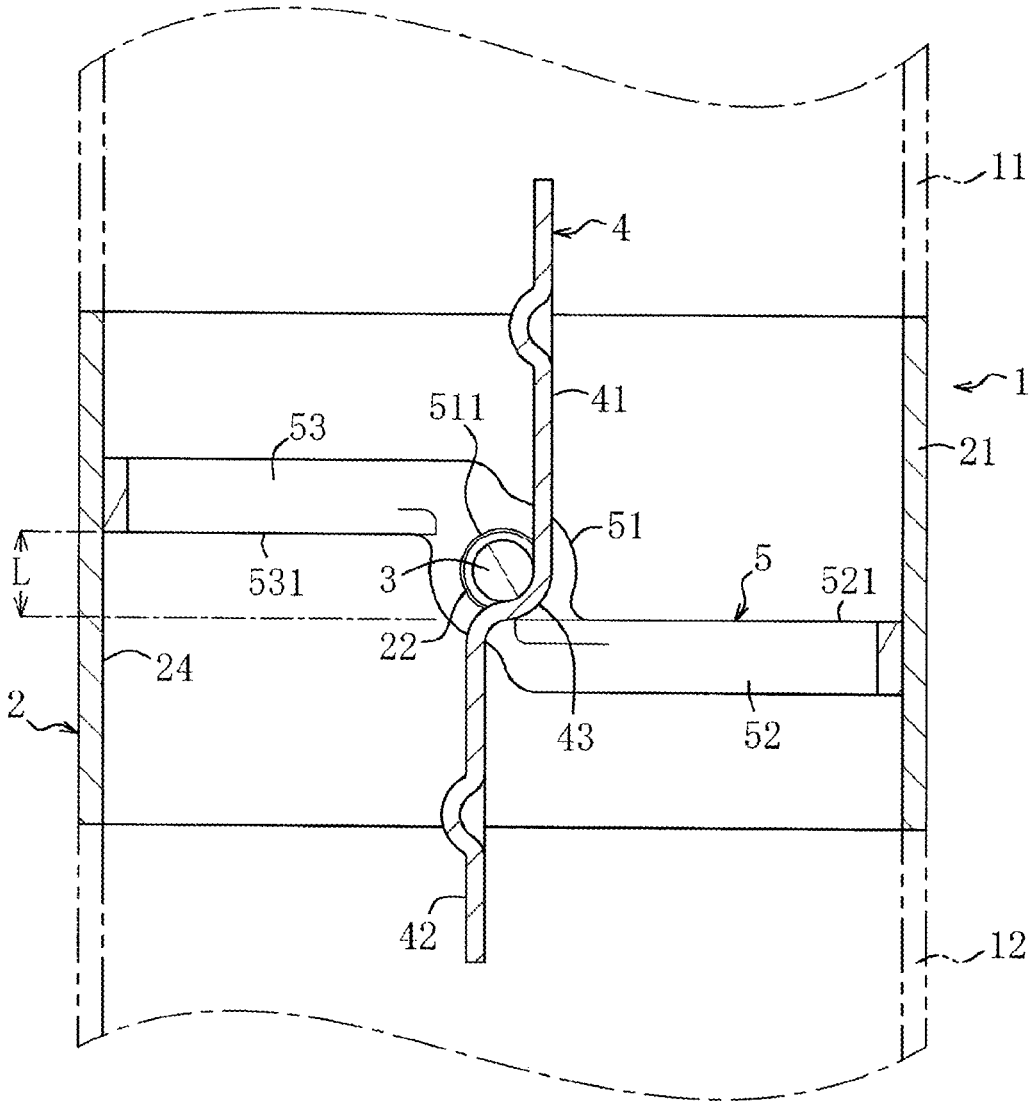
FIG. 3 is a longitudinal cross-sectional view illustrating the open state of the exhaust valve according to the embodiment as viewed from a bottom face side.
Figure 4:
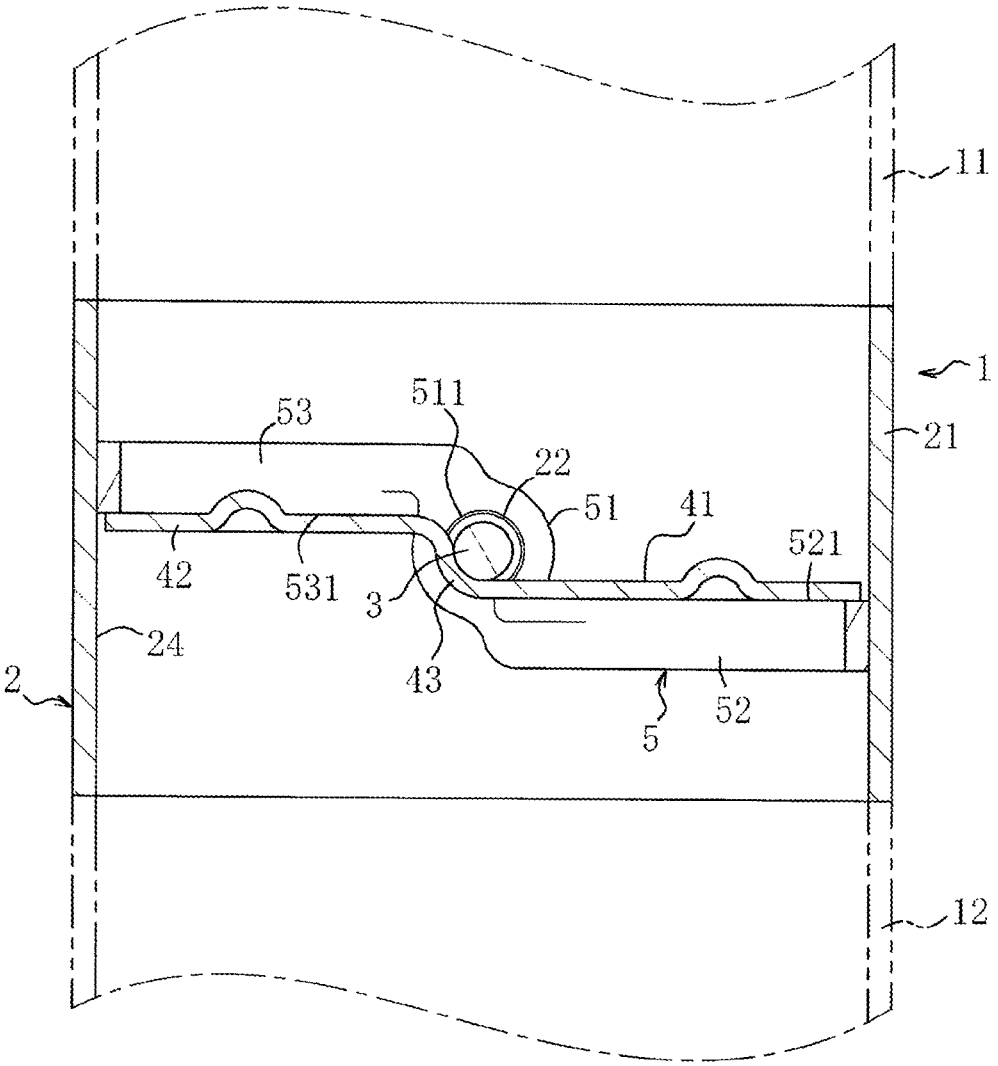
FIG. 4 is a longitudinal cross-sectional view illustrating the closed state of the exhaust valve according to the embodiment as viewed from a bottom face side.

An exhaust valve 1 according to an embodiment of the present invention is installed in an exhaust path through which exhaust of an automobile flows and uses an open/close operation to regulate a flow rate of the exhaust and exhaust noise. As illustrated in FIGS. 1 to 5, the exhaust valve 1 includes a pipe body 2 having a substantially cylindrical shape, a rotary shaft 3 disposed in a direction orthogonal to an axial direction of the pipe body 2 and provided extending through a peripheral wall 21 through a substantial center of the pipe body 2, a valve plate 4 disposed inside of the pipe body 2 and attached to a rotary shaft 3 by fixing, and a stopper 5 fixed inside of the pipe body 2.

The pipe body 2 connects an upstream pipe 11 and a downstream pipe 12 for exhaust, which configure the exhaust path. The upstream pipe 11 is fixed to one end portion side of the pipe body 2 in the pipe axial direction, and the downstream pipe 12 is fixed to another end portion side of the pipe body 2. Any method can be used to fix the upstream pipe 11 and the downstream pipe 12 for exhaust to the pipe body 2. Examples of the method include, for example, fixing the upstream pipe 11 to one end portion of the pipe body 2 in the pipe axial direction and the downstream pipe 12 to another end portion of the pipe body 2 by butt welding, internally fitting the upstream pipe 11 to one end portion side of the pipe body 2 in the pipe axial direction and the downstream pipe 12 to another end portion side of the pipe body 2 and fixing the upstream pipe 11 and the downstream pipe 12 to the pipe body 2 by fillet welding or penetration welding, and externally fitting the upstream pipe 11 to one end portion side of the pipe body 2 in the pipe axial direction and the downstream pipe 12 to another end portion side of the pipe body 2 and fixing the upstream pipe 11 and the downstream pipe 12 to the pipe body 2 by fillet welding or penetration welding.

Rotary shaft insertion holes 22 and 23 are formed in the peripheral wall 21 of the pipe body 2 at opposing positions in the radial direction. The rotary shaft 3 is disposed such that one end portion of the rotary shaft 3 in the axial direction is inserted into the rotary shaft insertion hole 22 and another end portion of the rotary shaft 3 is inserted into the rotary shaft insertion hole 23. A bearing case 61 having a substantially hat-like shape and an open apex portion is disposed outward of the rotary shaft insertion hole 22, and a flange portion 611 deformed to a shape matching an outer peripheral surface of the peripheral wall 21 of the pipe body 2 is disposed along the outer peripheral surface of the peripheral wall 21. The flange portion 611 and the peripheral wall 21 are fixed to each other by welding or the like. The bearing case 61 houses a bearing 71 and the bearing 71 axially supports one end portion of the rotary shaft 3 in the axial direction that protrudes outward of the pipe body 2 from the rotary shaft insertion hole 22.

A bearing case 62 having a substantially hat-like shape is disposed outward of the rotary shaft insertion hole 23, and a flange portion 621 deformed to a shape matching the outer peripheral surface of the peripheral wall 21 of the pipe body 2 is disposed along the outer peripheral surface of the peripheral wall 21. The flange portion 621 and the peripheral wall 21 are fixed to each other by welding or the like. The bearing case 62 houses a bearing 72 and the bearing 72 axially supports the other end portion of the rotary shaft 3 in the axial direction that protrudes outward of the pipe body 2 from the rotary shaft insertion hole 23.

The one end portion of the rotary shaft 3 in the axial direction protrudes further outward than the bearing 71 and is coupled to a drive transmission portion 81 of the actuator 8. The rotary shaft 3 is configured to be operated to rotate via the drive transmission portion 81 by drive of the actuator 8. Rotation of the rotary shaft 3 causes the valve plate 4 to rotate and open/close the exhaust flow path in the pipe body 2.

The valve plate 4 is formed in a substantially circular shape in a front view in the illustrated example, and has a stepped shape including, formed integrally, a first flat plate portion 41 having a substantially semicircular shape and a second flat plate portion 42 having a substantially semicircular shape, which are continuous via a curved plate portion 43. The first flat plate portion 41 having a substantially semicircular shape and the second flat plate portion 42 having a substantially semicircular shape are disposed extending substantially in parallel. The first flat plate portion 41 is formed to be longer in the direction orthogonal to the axial direction of the rotary shaft 3 than the second flat plate portion 42 and to have a larger area than the second flat plate portion 42. The curved plate portion 43 provided between the first flat plate portion 41 and the second flat plate portion 42 is disposed substantially along the outer peripheral surface of the rotary shaft 3 and is fixed to the rotary shaft 3 by welding or the like.

As illustrated in FIGS. 2 to 6, the stopper 5 is an integrally formed member having a substantially C-shape in a front view. The stopper 5 includes a base portion 51 including an insertion hole 511 configured to receive insertion of the rotary shaft 3, a first contact portion 52 having a substantially arc shape and formed on one side of the base portion 51 upstream and downstream of the exhaust and a second contact portion 53 having a substantially arc shape and formed on another side of the base portion 51 upstream and downstream of the exhaust. The first contact portion 52 having a substantially arc shape runs along an inner peripheral surface 24 of the pipe body 2, and the second contact portion 53 having a substantially arc shape runs along the inner peripheral surface 24 of the pipe body 2 and extends along a side opposite to the first contact portion 52 in a pipe body circumferential direction, inside of the pipe body 2. The stopper 5 is fixed to the peripheral wall 21 of the pipe body 2 by a welding method such as penetration welding, or the like.

Figure 5:
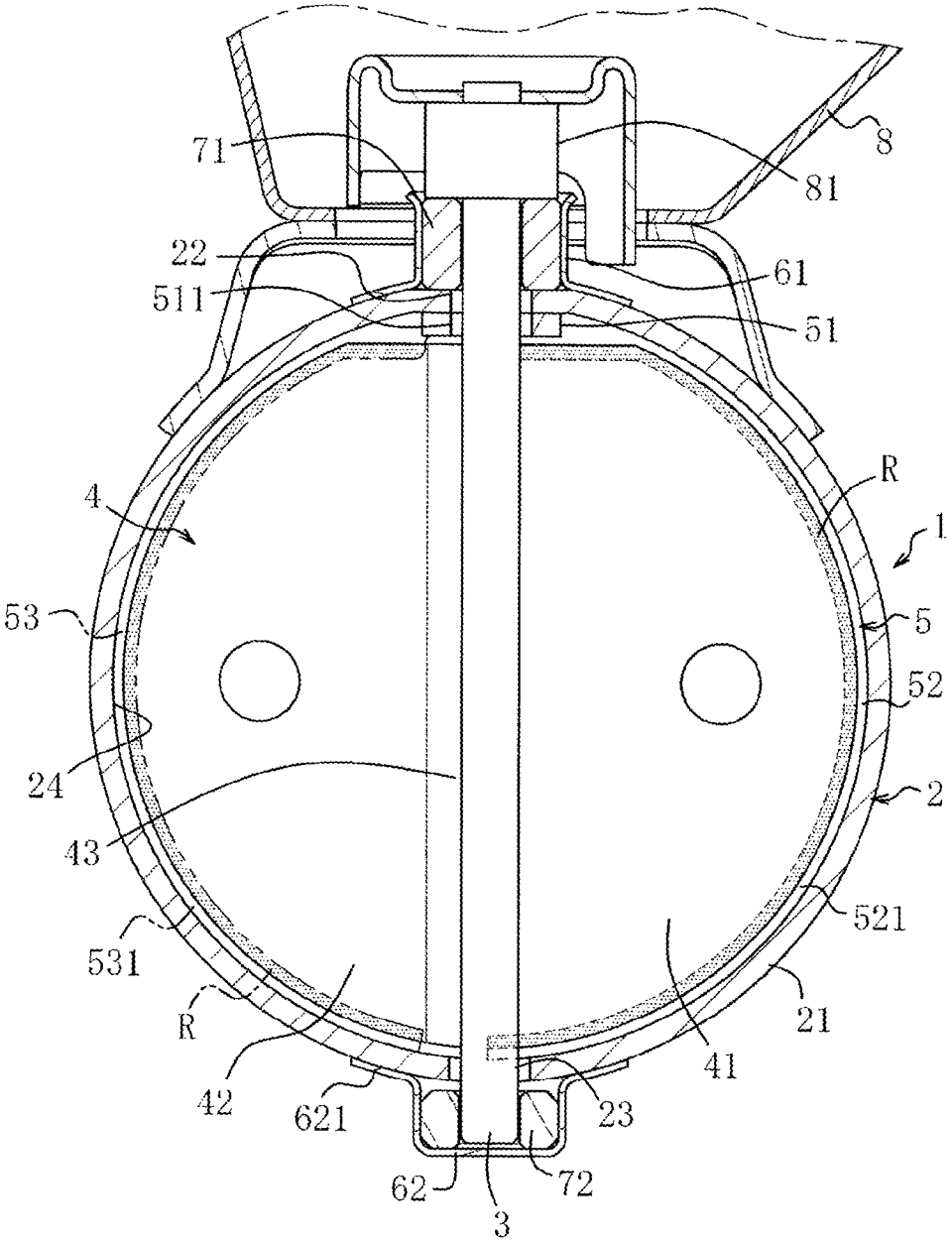
FIG. 5 is a partial cross-sectional view illustrating the closed state of the exhaust valve according to the embodiment.
Figure 6A:
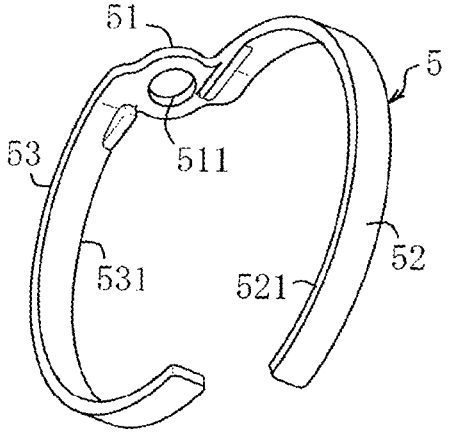
FIG. 6(*a*) is a perspective view of a stopper in the exhaust valve according to the embodiment, FIG. 6(*b*) is a plan view of the stopper, FIG. 6(*c*) is a side view of the stopper, and FIG. 6(*d*) is a bottom view of the stopper.
Figure 6B:
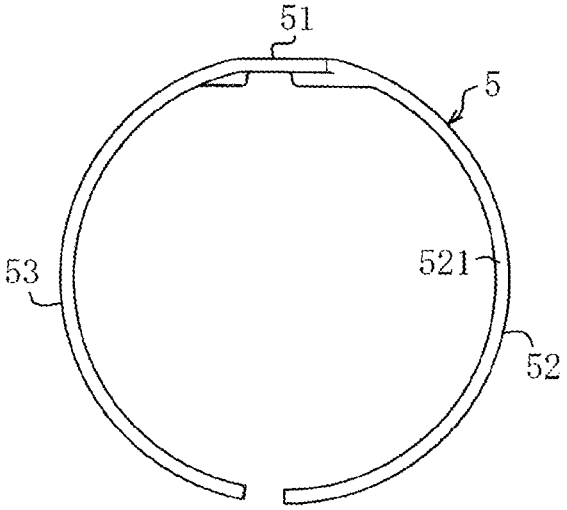
Figure 6C:
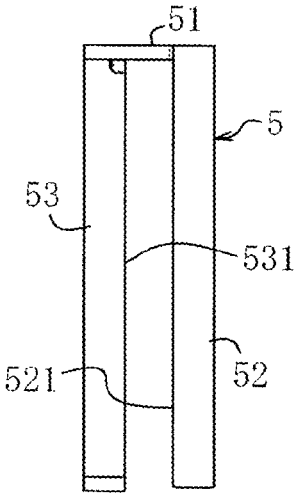
Figure 6D:
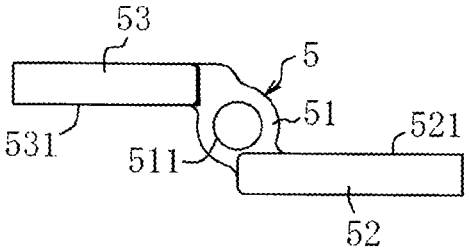

The first contact portion 52 and the second contact portion 53 of the stopper 5 are formed and disposed at positions abutting against the valve plate 4 in a state where the rotating valve plate 4 reaches a position of closing the exhaust flow path. Further, a contact surface 521, of the first contact portion 52, at which the valve plate 4 makes contact and a contact surface 531, of the second contact portion 53, at which the valve plate 4 makes contact make contact with the valve plate 4 that has reached the position of closing the exhaust flow path of the pipe body 2 to restrict rotational operation of the valve plate 4. FIG. 5 illustrates the valve plate 4 at the position of closing the exhaust flow path of the pipe body 2 and a contact region R formed when the contact surface 521 of the first contact portion 52 and the contact surface 531 of the second contact portion 53 come into contact with the valve plate 4.

In the stopper 5, a distance L, in the axial direction of the pipe body 2, between the contact surface 521, of the first contact portion 52, at which the valve plate 4 makes contact and the contact surface 531, of the second contact portion 53, at which the valve plate 4 makes contact is set and formed larger than the axial diameter of the rotary shaft 3. A distal end of the first contact portion 52 having a substantially arc shape and a distal end of the second contact portion 53 having a substantially arc shape are configured to not come into contact with a portion in the vicinity of the other end portion of the rotary shaft 3 in the axial direction located in the vicinity of the rotary shaft insertion hole 23, and to not interfere with the portion in the vicinity of the other end portion of the rotary shaft 3 (see FIGS. 3 and 2).

In the exhaust valve 1 according to the present embodiment, drive of the actuator 8 is controlled by control performed by a control device (not illustrated), and the rotary shaft 3 and the valve plate 4 are rotated to switch between an open state and a closed state. When the exhaust valve 1 is in the open state, a direction in which surfaces of the first flat plate portion 41 and the second flat plate portion 42 of the valve plate 4 extend follows the exhaust flow path inside the pipe body 2 and the pipe axial direction (see FIGS. 2 and 3). When the exhaust valve 1 is in the closed state, the first flat plate portion 41 and the second flat plate portion 42 of the valve plate 4 are disposed blocking the exhaust flow path inside the pipe body 2, the first flat plate portion 41 abuts against the contact surface 521 of the first contact portion 52 of the stopper 5 and the second flat plate portion 42 abuts against the contact surface 531 of the second contact portion 53 of the stopper 5 to close and suppress flow of the exhaust in the downstream pipe 12 to the extent possible (see FIGS. 1, 4 and 5).

Further, manufacturing the exhaust valve 1 according to the present embodiment includes aligning the position of the insertion hole 511 of the base portion 51 of the stopper 5, which is a member including, formed integrally, the first contact portion 52, the second contact portion 53 and the base portion 51 including the insertion hole 511 configured to receive insertion of the rotary shaft 3 and the position of the rotary shaft insertion hole 22 formed in the peripheral wall 21 of the pipe body 2, to fit the stopper 5 into the pipe body 2. Accordingly, the exhaust valve 1 can be easily assembled while ensuring required concentricity, with the position alignment of the insertion hole 511 and the rotary shaft insertion hole 22 serving as a reference.

With the exhaust valve 1 according to the present embodiment, since the stopper 5 is formed as an integral member, the number of components can be reduced, the number of positioning and fitting mechanisms and the number of positioning and fitting processes used to position the stopper 5 and the pipe body 2 can be reduced, manufacturing efficiency can be improved, and manufacturing costs can be reduced. In addition, since one stopper 5, which is formed as an integral member, and the pipe body 2 need only be fitted together for assembly, gaps used for fitting and positioning can be reduced, fitting accuracy between the stopper 5 and the pipe body 2 and product accuracy after assembly can be enhanced, and product quality of the exhaust valve 1 can be improved.

Further, since both the first contact portion 52 and the second contact portion 53 are formed in a substantially arc shape and the distance L, in the axial direction of the pipe body 2, between the contact surface 521, of the first contact portion 52, at which the valve plate 4 makes contact and the contact surface 531, of the second contact portion 53, at which the valve plate 4 makes contact is set larger than the axial diameter of the rotary shaft 3, interference and contact between the first contact portion 52 and the second contact portion 53 and the rotary shaft 3 of the valve plate 4 at positions opposing the base portion 51 of the stopper 5 in the pipe body 2 can be prevented, and assembly work of the rotary shaft 3 can be facilitated. In addition, the distal end of the first contact portion 52 having a substantially arc shape can be made to extend until a position overlapping the rotary shaft 3 in the pipe body axial direction, the distance and area by which the contact surface 521 of the first contact portion 52 comes into contact with the valve plate 4 can be increased, and exhaust leakage when the valve plate is at the closed position can be suppressed to the extent possible. In addition, while manufacturing accuracy can be improved due to the position alignment between the rotary shaft insertion hole 22 of the pipe body 2 and the insertion hole 511 of the rotary shaft 3 of the base portion 51, since the first contact portion 52 and the second contact portion 52 having substantially arc shapes are disposed separated from each other at positions opposing the base portion 51 of the stopper 5 in the pipe body 2, the tolerance for dimensional accuracy and yield can be increased.

In addition, the position of the insertion hole 511 of the rotary shaft 3 of the base portion 51 of the stopper 5 and the position of the rotary shaft insertion hole 22 formed in the peripheral wall 21 of the pipe body 2 are aligned and, if this alignment is used as a reference when assembling the exhaust valve, manufacturing work can be facilitated. Further, required concentricity between the insertion hole 511 of the rotary shaft 3 of the stopper 5, the rotary shaft insertion hole 22 formed in the peripheral wall of the pipe body, and the rotary shaft 3 can be easily ensured and, from this perspective, manufacturing accuracy and manufacturing quality of the exhaust valve 1 can be increased. Additionally, since required concentricity between the insertion hole 511 of the rotary shaft 3 of the stopper 5, the rotary shaft insertion hole 22 formed in the peripheral wall of the pipe body, and the rotary shaft 3 can be more easily ensured, friction generated in the rotation operation of the rotary shaft 3 and the valve plate 4 can be reduced for a smoother rotation operation, the valve plate 4 can be made to more reliably come into contact with the contact surface 521 of the first contact portion 52 and the contact surface 531 of the second contact portion 53 at a set contact distance and contact area, and exhaust leakage when the valve plate is at the closed position can be suppressed to the extent possible.

Scope of Inclusion of Invention Disclosed in Present Specification

The invention disclosed in the present specification includes, in addition to the inventions listed as inventions and embodiments, those specified by changing the partial contents thereof to other contents disclosed in the present specification to an applicable extent, those specified by adding other contents disclosed in the present specification to these contents, or those specified by deleting these partial contents to the extent that a partial action and effect can be obtained and making them into a higher concept. The invention disclosed in the present specification also includes the following modifications and additions.

For example, the stopper 5 in the above-described embodiment is described an integrally formed member having a substantially C-shape in a front view, but the stopper in the exhaust valve according to the present invention can have any shape included in the scope of the present invention. For example, the stopper 5 may be an integrally formed member having a substantially 0-shape in a front view formed by coupling, to a second base portion including an insertion hole configured to receive insertion of the other end side of the rotary shaft 3, the distal end of the first contact portion 52 having a substantially arc shape and made to run along the inner peripheral surface 24 of the pipe body 2 on one side of the base portion 51 and the distal end of the second contact portion 53 having a substantially arc shape and made to run along a side opposite to the first contact portion 52 along the inner peripheral surface 24 of the pipe body 2 on the other side of the base portion 51.

Additionally, the shape of the valve plate in the exhaust valve 1 according to the present invention is not limited to that of the valve plate 4 having an integrally formed stepped shape in which the first flat plate portion 41 having a substantially semicircular shape and the second flat plate portion 42 having a substantially semicircular shape in the embodiment described above are continuous via the curved plate portion 43. The valve plate may have any shape included in the scope of the present invention.

INDUSTRIAL APPLICABILITY

The present invention can be applied to an exhaust valve that is installed in an exhaust path through which exhaust from an automobile or the like flows and that uses an open/close operation to regulate flow rate of the exhaust and exhaust noise.

REFERENCE SIGNS LIST

1 Exhaust valve
2 Pipe body
21 Peripheral wall
22, 23 Rotary shaft insertion hole
24 Inner peripheral surface
3 Rotary shaft
4 Valve plate
41 First flat plate portion
42 Second flat plate portion
43 Curved plate portion
5 Stopper
51 Base portion
511 Insertion hole
52 First contact portion
521 Contact surface
53 Second contact portion
531 Contact surface

61, 62 Bearing case
611, 621 Flange portion
71, 72 Bearing
8 Actuator
81 Drive transmission portion
11 Upstream pipe
12 Downstream pipe
R Contact region formed when contact surface of first contact portion and contact surface of second contact portion come into contact with valve plate
L Distance, in axial direction of pipe body, between contact surface of first contact portion and contact surface of second contact portion

The invention claimed is:

1. An exhaust valve comprising:

a pipe body connecting an upstream pipe and a downstream pipe for exhaust;

a valve plate disposed inside the pipe body in a state of being attached to a rotary shaft that rotates by drive of an actuator, the valve plate configured to rotate to open/close an exhaust flow path inside the pipe body; and a stopper fixed inside the pipe body, wherein the stopper is a member including, formed integrally, a base portion including an insertion hole configured to receive insertion of the rotary shaft, a first contact portion extending along an inner peripheral surface of the pipe body on one side of the base portion upstream and downstream of the exhaust, and a second contact portion extending along the inner peripheral side of the pipe body on another side of the base portion upstream and downstream of the exhaust, on a side opposite to the first contact portion, and the valve plate comes into contact with the first contact portion and the second contact portion at a position at which the valve plate closes the exhaust flow path, wherein the stopper is an integral member comprising the base portion, the first contact portion and the second contact portion, the insertion hole of the base portion is located at a substantial center of the base portion such that the insertion hole is entirely surrounded by the base portion.

2. The exhaust valve according to claim 1, wherein the first contact portion and the second contact portion are each formed in a substantially arc shape, and a distance, in an axial direction of the pipe body, between a contact surface, of the first contact portion, at which the valve plate makes contact and a contact surface, of the second contact portion, at which the valve plate makes contact is set larger than an axial diameter of the rotary shaft.

3. A method for manufacturing the exhaust valve described in claim 1, the method comprising:

a step of aligning a position of the insertion hole of the base portion of the stopper being a member including, formed integrally, the base portion including the insertion hole configured to receive insertion of the rotary shaft, the first contact portion extending along the inner peripheral surface of the pipe body on one side of the base portion upstream and downstream of the base portion, and the second contact portion extending along the inner peripheral side of the pipe body on another side of the base portion upstream and downstream of the base portion, on a side opposite to the first contact portion, and a position of a rotary shaft insertion hole formed in a peripheral wall of the pipe body connecting an upstream pipe and a downstream pipe for exhaust, to fit the stopper into the pipe body.

4. A method for manufacturing the exhaust valve described in claim 2, the method comprising:

a step of aligning a position of the insertion hole of the base portion of the stopper being a member including, formed integrally, the base portion including the insertion hole configured to receive insertion of the rotary shaft, the first contact portion extending along the inner peripheral surface of the pipe body on one side of the base portion upstream and downstream of the base portion, and the second contact portion extending along the inner peripheral side of the pipe body on another side of the base portion upstream and downstream of the base portion, on a side opposite to the first contact portion, and a position of a rotary shaft insertion hole formed in a peripheral wall of the pipe body connecting an upstream pipe and a downstream pipe for exhaust, to fit the stopper into the pipe body.

* * * * *